US009200402B2

(12) United States Patent
Wisherd et al.

(10) Patent No.: US 9,200,402 B2
(45) Date of Patent: Dec. 1, 2015

(54) DIELECTRIC DRYER DRUM

(71) Applicant: Cool Dry LLC, San Jose, CA (US)

(72) Inventors: David S. Wisherd, Carmel, CA (US); John A. Eisenberg, Los Altos, CA (US); Pablo Eugenio D'Anna, Santa Barbara, CA (US)

(73) Assignee: Cool Dry, Inc., San Jose, CA (US)

( * ) Notice: Subject to any disclaimer, the term of this patent is extended or adjusted under 35 U.S.C. 154(b) by 0 days.

(21) Appl. No.: 14/336,599

(22) Filed: Jul. 21, 2014

(65) Prior Publication Data

US 2014/0325865 A1 Nov. 6, 2014

Related U.S. Application Data

(63) Continuation-in-part of application No. 13/112,880, filed on May 20, 2011.

(60) Provisional application No. 61/961,786, filed on Oct. 23, 2013.

(51) Int. Cl.
*F26B 3/34* (2006.01)
*D06F 58/04* (2006.01)
(Continued)

(52) U.S. Cl.
CPC ..... *D06F 58/04* (2013.01); *D06F 58/266* (2013.01); *F26B 3/343* (2013.01); *F26B 11/0495* (2013.01)

(58) Field of Classification Search
CPC ..... D06F 58/02; D06F 58/10; F26B 3/28; F26B 3/34
USPC ..... 34/255, 259, 260, 261, 246
See application file for complete search history.

(56) References Cited

U.S. PATENT DOCUMENTS 2,472,193 A 6/1949 Clayton
2,511,839 A * 6/1950 Frye ..... 34/255
(Continued)

FOREIGN PATENT DOCUMENTS

EP 0 862 218 A1 9/1998
EP 1 753 265 A1 2/2007
(Continued)

OTHER PUBLICATIONS

International Search Report (ISA/US) mailed Sep. 15, 2011 for international patent application PCT/US2011/038594 filed May 31, 2011, 3 pages.
(Continued)

*Primary Examiner* — Kenneth Rinehart
*Assistant Examiner* — John McCormack
(74) *Attorney, Agent, or Firm* — Edward J. Radlo; Radlo IP Law Group

(57) ABSTRACT

Methods and apparatus for heating an object 9 that includes an absorbed medium. A method embodiment comprises: placing the object 9 including the medium into an enclosure 16; initiating a heating process by subjecting the object 9 and medium to a capacitive AC electrical field generated by an RF power source 2 at a single low frequency; controlling the heating process by taking real time measurements; and making real time adjustments to the RF power source 2 in response to the real time measurements. The object 9 substantially absorbs the medium in a first "cool" state, and therefore has a maximum weight in the first "cool" state. The object 9 is substantially free from the medium in a second "heated" state, due to substantial release of the medium from the object 9. The released medium is evaporated during the heating process. The heating process is completed when the object 9 is substantially transitioned into the second "heated" state. The method further comprises causing an air flow 11 inside the enclosure 16 to carry away evaporated medium out of the enclosure 16.

29 Claims, 9 Drawing Sheets

(51) Int. Cl.

| | |
|---|---|
| ***D06F 58/26*** | (2006.01) |
| ***F26B 11/04*** | (2006.01) |

(56) References Cited

U.S. PATENT DOCUMENTS

| | | | | |
|---|---|---|---|---|
| 3,605,272 | A * | 9/1971 | Boucher | 34/261 |
| 3,854,219 | A * | 12/1974 | Staats | 34/265 |
| 3,866,255 | A | 2/1975 | Serota | |
| 3,938,260 | A | 2/1976 | Brenner et al. | |
| 4,000,340 | A | 12/1976 | Murphy et al. | |
| 4,126,563 | A | 11/1978 | Barker | |
| 4,250,628 | A | 2/1981 | Smith et al. | |
| 4,334,136 | A | 6/1982 | Mahan et al. | |
| 4,356,640 | A | 11/1982 | Jansson | |
| 4,490,923 | A | 1/1985 | Thomas | |
| 5,463,821 | A * | 11/1995 | Gauer | 34/261 |
| 5,712,469 | A | 1/1998 | Chaffin et al. | |
| 5,869,817 | A | 2/1999 | Zietlow et al. | |
| 5,983,520 | A | 11/1999 | Kim et al. | |
| 6,124,624 | A | 9/2000 | Van Roosmalen et al. | |
| 6,141,634 | A | 10/2000 | Flint et al. | |
| 6,344,638 | B1 | 2/2002 | Tomasello | |
| 6,417,499 | B2 | 7/2002 | Blaker et al. | |
| 6,423,955 | B1 | 7/2002 | Blaker et al. | |
| 6,657,173 | B2 | 12/2003 | Flugstad et al. | |
| 6,825,618 | B2 | 11/2004 | Pu et al. | |
| 6,914,226 | B2 | 7/2005 | Ottaway | |
| 6,971,189 | B1 | 12/2005 | Anibas | |
| 7,034,266 | B1 | 4/2006 | DeGroot et al. | |
| 7,325,330 | B2 | 2/2008 | Kim et al. | |
| 7,380,423 | B1 | 6/2008 | Musone | |
| 7,933,733 | B2 | 4/2011 | Ashrafzadeh et al. | |
| 8,035,255 | B2 | 10/2011 | Kurs et al. | |
| 8,058,588 | B2 | 11/2011 | Gagas et al. | |
| 8,215,133 | B2 | 7/2012 | Kim et al. | |
| 8,405,467 | B2 | 3/2013 | He | |
| 8,826,561 | B2 | 9/2014 | Wisherd et al. | |
| 8,943,705 | B2 | 2/2015 | Wisherd et al. | |
| 2002/0047009 | A1 | 4/2002 | Flugstad et al. | |
| 2003/0224965 | A1 | 12/2003 | Conley et al. | |
| 2004/0031731 | A1 | 2/2004 | Honeycutt et al. | |
| 2004/0261286 | A1 | 12/2004 | Green et al. | |
| 2006/0109327 | A1 | 5/2006 | Diamond et al. | |
| 2007/0045307 | A1 * | 3/2007 | Tsui et al. | 219/775 |
| 2007/0085689 | A1 | 4/2007 | Brommer et al. | |
| 2007/0163144 | A1 | 7/2007 | Dittmer et al. | |
| 2007/0251118 | A1 | 11/2007 | Doh | |
| 2007/0271814 | A1 | 11/2007 | Bae et al. | |
| 2008/0307667 | A1 | 12/2008 | Ikemizu | |
| 2009/0236334 | A1 * | 9/2009 | Ben-Shmuel et al. | 219/703 |
| 2009/0255145 | A1 | 10/2009 | Poy | |
| 2009/0272004 | A1 * | 11/2009 | Chernetski et al. | 34/389 |
| 2010/0115708 | A1 | 5/2010 | Caswell et al. | |
| 2010/0115785 | A1 | 5/2010 | Ben-Shmuel et al. | |
| 2010/0166818 | A1 | 7/2010 | Troutman | |
| 2010/0236088 | A1 * | 9/2010 | Paice | 34/255 |
| 2011/0067186 | A1 | 3/2011 | Johansson | |
| 2011/0146102 | A1 * | 6/2011 | Bellinetto et al. | 34/549 |
| 2012/0096737 | A1 | 4/2012 | Kmet et al. | |
| 2012/0125909 | A1 * | 5/2012 | Scheunert et al. | 219/222 |
| 2012/0291304 | A1 | 11/2012 | Wisherd et al. | |
| 2013/0119055 | A1 | 5/2013 | Wohl et al. | |
| 2015/0020403 | A1 | 1/2015 | Herman et al. | |
| 2015/0047218 | A1 | 2/2015 | Herman et al. | |
| 2015/0047219 | A1 | 2/2015 | Lee et al. | |
| 2015/0051738 | A1 | 2/2015 | Lee et al. | |
| 2015/0052774 | A1 | 2/2015 | Herman et al. | |
| 2015/0052775 | A1 | 2/2015 | Herman et al. | |
| 2015/0089829 | A1 | 4/2015 | Herman et al. | |
| 2015/0101207 | A1 | 4/2015 | Herman et al. | |

FOREIGN PATENT DOCUMENTS

| | | | |
|---|---|---|---|
| GB | 835454 | A | 5/1960 |
| WO | 97/32071 | A1 | 9/1997 |
| WO | 03/019985 | A1 | 3/2003 |
| WO | 2011/159462 | A1 | 12/2011 |
| WO | 2012/161889 | A1 | 11/2012 |
| WO | 2013/074262 | A1 | 5/2013 |
| WO | 2014/104451 | A1 | 7/2014 |

OTHER PUBLICATIONS

Written Opinion of the International Searching Authority (ISA/US) mailed Sep. 15, 2011 for international patent application PCT/US2011/038594 filed May 31, 2011, 15 pages.

International Search Report (ISA/US) mailed Aug. 3, 2012 for international patent application PCT/US2012/033900 filed Apr. 17, 2012, 4 pages.

Written Opinion of the International Searching Authority (ISA/US) mailed Aug. 3, 2012 for international patent application PCT/US2012/033900 filed Apr. 17, 2012, 6 pages.

International Search Report (ISA/US) mailed Jan. 25, 2013 for international patent application PCT/US2012/061736 filed Oct. 24, 2012, 3 pages.

Written Opinion of the International Searching Authority (ISA/US) mailed Jan. 25, 2013 for international patent application PCT/US2012/061736 filed Oct. 24, 2012, 5 pages.

"Specification sheet for 1 KW Class E Module PRF-1150 power module, © 2002 Directed Energy, Inc., downloaded on Mar. 17, 2014 from: http://lxys.com/SearchResults.aspx?search=class+E&SearchSubmit=Go, 17 pages".

Wilson et al., Radio-Frequency Dielectric Heating in Industry, Thermo Energy Corporation, Palo Alto, California, Final Report, Mar. 1987. Retrieved from Internet URL: http://infohouse.p2ric.org/ref/39/38699.pdf.

* cited by examiner

DIELECTRIC DRYER DRUM

RELATED APPLICATIONS

This patent application is a continuation-in-part of U.S. patent application Ser. No. 13/112,880 filed May 20, 2011, which was published as US2012/0291304 A1 on Nov. 22, 2012, and also claims the priority benefit of U.S. provisional patent application 61/961,786 filed Oct. 23, 2013; both of said prior patent applications are hereby incorporated by reference in their entireties into the present patent application.

TECHNICAL FIELD

This invention relates to the field of Radio Frequency (RF) heating systems, particularly as applied to clothes dryers.

BACKGROUND ART

Conventional clothes dryers heat a large volume of air that then passes over tumbling clothes. Water is extracted from the wet clothes by evaporation into the heated air. This conventional drying process is extremely inefficient, as most of the energy consumed by the dryer goes out a vent.

This invention is a new way to use low frequency RF (roughly 10 MHz to 100 MHz) capacitive electrical energy to replace the conventional forced hot air clothes dryer that has been used since it was introduced almost 75 years ago. In the present invention, water is evaporated by heat of friction of the water molecules vibrating at the RF frequency. The resulting water vapor is carried away by forced air. The wet clothes load appears as a capacitive electrical element through which the low frequency RF current flows, exciting the molecules of water so that their energy is raised above the heat of vaporization, causing a state change from liquid to vapor.

A number of approaches have been presented that use electrical, magnetic, or electromagnetic energy to dry fabrics, all of them with inherent inconveniences and/or shortcomings due to failure of the designers to comprehend optimum means to couple RF energy to the drying fabrics.

For example, W. N. Frye in U.S. Pat. No. 2,511,839 issued Jun. 20, 1950 describes a "Method and Apparatus for Drying Textile Materials by High-Frequency Electric Fields" where the requirements are for a nonconductive container drum. Frye's drum needs to be non-conductive (i.e., insulating) for the electric fields to reach the load, because his electrodes are rings or coils set up OUTSIDE of the clothes drum (if it were a metallic drum, it would act as a Faraday shield to the load, and no energy would be transmitted through it). This condition applies to the embodiments disclosed in Frye's FIGS. 1,2,3,4 and 10. In the embodiment disclosed in FIG. 4, Frye uses a couple of plate electrodes instead of rings, but they are also positioned outside the drum (attached to the insulating member that surrounds the drum, column 4, lines 13-14). While Frye develops heating energy by applying a high frequency electric (or magnetic in other embodiments) field to the load, he does not disclose a frequency of operation, a tuning network, or a means to detect the degree of humidity or other parameters as the drying proceeds as in the present invention. Furthermore, in many embodiments of the present invention, the drum is electrically conductive.

In the embodiment depicted in FIGS. 7 and 8, one of Frye's electrodes seems to be statically positioned inside the drum, like a cantilever beam, but secured to the front wall of the machine (column 6, lines 14 to 22), with the drum rotating around it. The other electrode is placed outside the drum (column 6, lines 22 to 26). There is no physical contact of the electrodes with the load. Both electrodes are separated from the load; thus, coupling is reduced by the introduction of an additional air series capacitance that reduces the amount of current flowing through the load.

Eran Ben-Shmuel et al., in U.S. published patent application US2010/0115785 A1 published May 13, 2010, describes a "Drying Apparatus and Methods and Accessories for Use Therewith" that consists of using multiple frequencies of electromagnetic RF energy set up in a cavity to dry clothes and heat foods. Ben-Shmuel uses an antenna to couple the field energy to the load. Ben-Shmuel teaches the use of a high frequency (>300 MHz) RF field to excite electromagnetic fields in a cavity. The present invention does not require a cavity with dimensions related to the wavelength of the applied RF energy as in Ben-Shmuel. Rather, the present invention seeks to maximize current flow though the capacitive coupled load.

Joseph A. Gauer, in U.S. Pat. No. 5,463,821 issued Nov. 7, 1995, describes a "Method and Apparatus for Operating a Microwave Dryer," which discloses inserting microwave magnetrons in the dryer impellers to provide the heating energy. Again, this is another high frequency approach as in Ben-Shmuel.

Tsui et al. in U.S. published patent application US2007/0045307 A1 published Mar. 1, 2007, describes a "Radio Frequency Textile Drying Machine," a stationary drum that can function as a cathode (or anode) having an anode (or cathode) spindle where wet textiles (supposedly in strips or yarn) are placed and are subjected to a 27 MHz RF field, to excite water molecules and create heat to evaporate the moisture. Air flow is provided to remove the moisture from the apparatus. There is a substantial air gap between the spindle and its yarn strip, and the drum. This air gap acts as a small capacitance (high reactance) in series with the capacitance (and parallel resistance) of the wet yarn, greatly reducing the amount of current available to add energy to the water molecules in the yarn. The present invention has no such energy-draining air gap. Also, Tsui does not disclose the present invention's dynamically matching network for efficient RF energy transmission to keep up with the impedance of the load changing as the load dries and loses water.

Serota, in U.S. Pat. No. 3,866,255 issued Feb. 18, 1995 entitled "Dielectric Apparatus for and Methods of Treating Traveling Paper Webs and the Like", discloses a flat arrangement of alternating anode and cathode bars (or a flat cathode plate) over which wet paper (in sheet form) is passed and heated by RF energy (no frequency specified, and no air blowing). In one embodiment of Serota, some tuning is obtained by a variable inductor and a moving capacitor plate that also serves as an RF connection to the anode bars.

These prior art approaches have not been practical, because of the difficulties of providing a non-conducting drum container; the fact that a cavity used as a drum limits the drum size due to the constraints to set up an electromagnetic field inside; non specificity of the optimum frequency range to use for optimum drying; and the problems that metal objects (such as zippers and buttons) have in overheating in high frequency RF and microwave fields.

SUMMARY OF THE INVENTION

In the present invention, an optimized, single, low RF frequency power source 2 is used, providing the heating energy in an enclosure 16, which can comprise a conventional rotating drum 1. Efficient delivery of the RF power 2 to the load 9 is achieved by maintaining close electrical contact of the load 9 to both an anode 6 and cathode 1 of the apparatus, offering an optimum solution in creating an improved highly energy-efficient clothes dryer. Impellers 8 are used to randomize the tumbling of the load 9 to improve evaporation of moisture in the load.

Here is why we use low frequency RF. It is well known by the consumer that trying to use a microwave oven as a dryer (which is basically the method used by Ben-Shmuel) has problems. Ben-Shmuel's assertion, in paragraph [0187] of U.S. published patent application US2010/0115785 A1 that:

> "... in fact, heating at a single frequency is found to be one of the main reasons of hot spots ..."

is valid only for high RF frequencies (mostly microwaves) such as Ben-Shmuel's frequencies, where the wavelength is short and the heating is non uniform due to the fact that the energy does not penetrate into the material, heating only the surface. Any user of a microwave oven trying to cook a thick steak has found out the need to stop the cooking in the middle of the process to reposition the steak to even out the heating.

More important perhaps, for an electric dryer use, is the fact that microwave energy, because of its short wavelength, couples to small metallic objects, like keys and zippers, and creates sufficient heating energy in them to produce arcing and start potential fires. This problem is completely avoided by the present invention.

We therefore use low frequency RF power (for example, in the range of 10 MHz to 100 MHz), where the longer wavelength (29.979 meters to 2.9979 meters) assures a better penetration of the heating energy into the drying object, and insuring a more uniform water removal.

Here is why we want electrical contact of the clothes to both the anode 6 and cathode 1 of our capacitive enclosure. At the low frequencies we use (in the range of 10 MHz to 100 MHz), it is not possible to insert an antenna small enough to match the load 9 impedance to the energy feed structure 2, 3, 10 used to deliver the power to the load 9. Our close electrical contact to the load 9 is a key factor that is missing in all the previous attempts to develop a low frequency RF fabric dryer. By substituting the electric field approach of energy delivery to the load 9 by a continuous electrical contact that minimizes the air gap between the clothes 9 and the electrodes 6, 1 (and therefore minimizes the parasitic series air capacitance), we are assured of an efficient transfer of heating energy 2 to the load 9.

BRIEF DESCRIPTION OF THE DRAWINGS

The accompanying drawings, which are incorporated in and form a part of this specification, illustrate embodiments of the invention and, together with the description, serve to explain the principles below.

Figure 2:
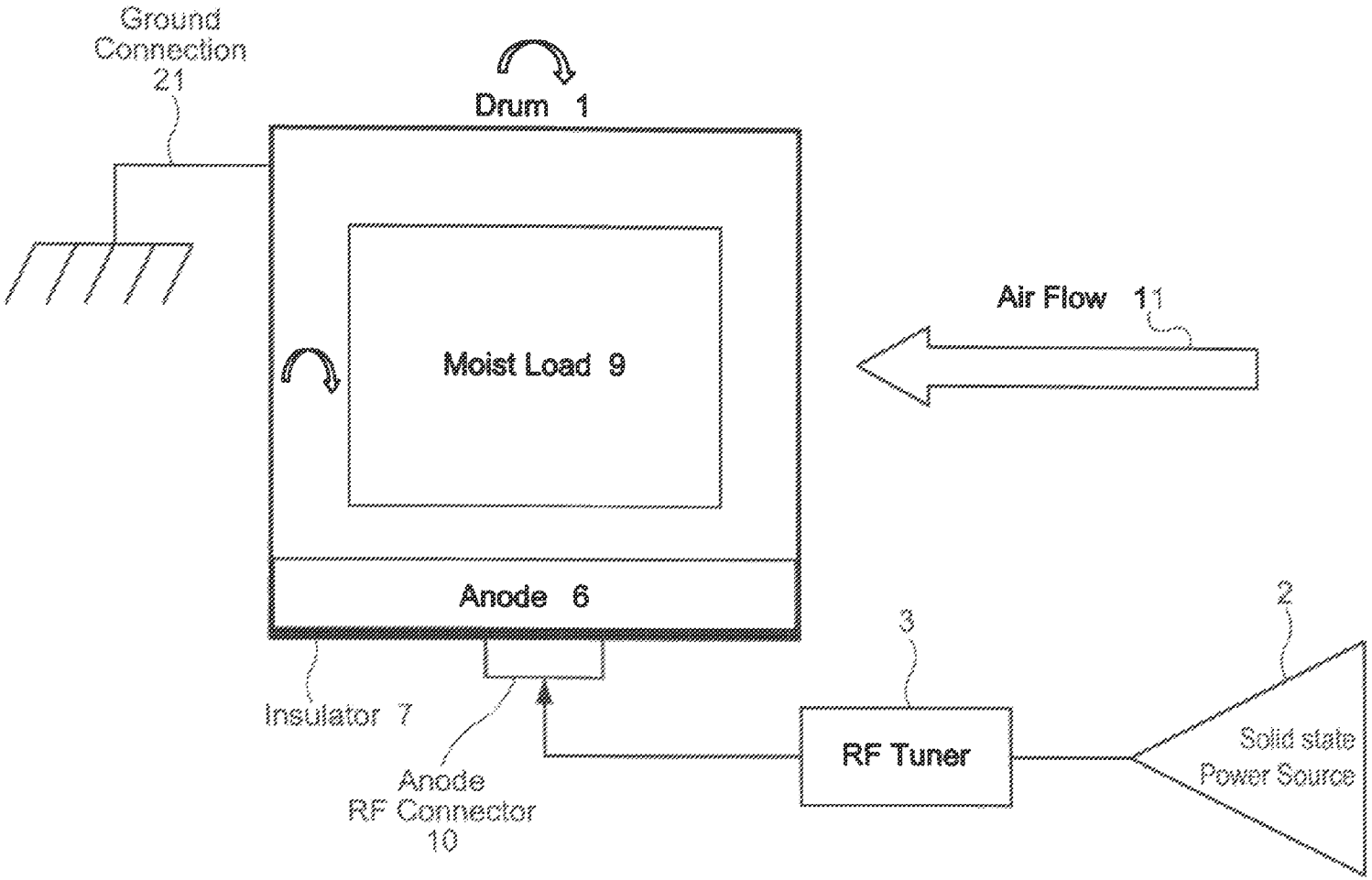

An axially disposed electrically conductive anode 6 sitting on top of an insulator 7 is coupled to solid state low frequency RF power supply 2 through a tuning network 3 and connector 10 (shown in FIG. 2). System controller 4 provides controlling signals to power source 2, and receives inputs from tuner 3 and a sensor network 14. The power source 2 is powered by an AC to DC power supply 5. Dryer drum 1 is electrically conductive, and acts as a cathode to complete the electrical circuit. Impellers (vanes) 8 are used to stir up the load (typically wet clothes) 9 inside the rotating drum 1. Impellers 8 may or may not be electrically connected to anode 6.

FIG. 2 shows a more detailed view of the structure of the apparatus of the present invention. Drum 1 rotates within outer enclosure 16 (see FIG. 1), with a heating electrical current applied to load 9 powered by a solid state, single low Frequency RF source 2 through RF tuner 3 to RF electrically conductive anode 6 through a fixed bottom anode drum connector 10. RF Load impedance Z, load size, and other parameters are measured by sensors 14 (see FIG. 1) to help system controller 4 (see FIG. 1) determine a time to end the drying, and to control settings of power source 2. Ground connection 21 completes the circuit.

Figure 3:
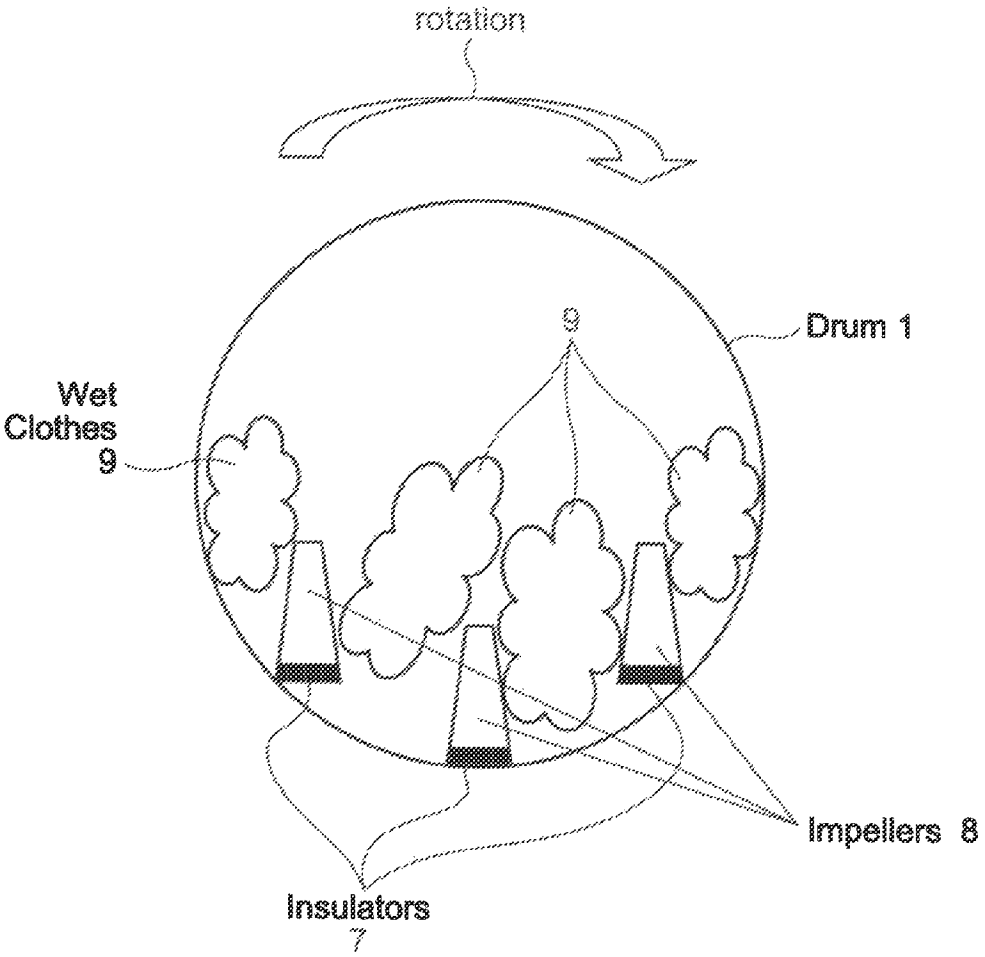

FIG. 3 shows an embodiment of the present invention featuring several anode impellers 8 inside drum 1, each separated from drum 1 by insulators 7, with clothes 9 in contact with both the set of anode impellers 8 and the body of the drum 1 acting as a cathode.

Figure 4:
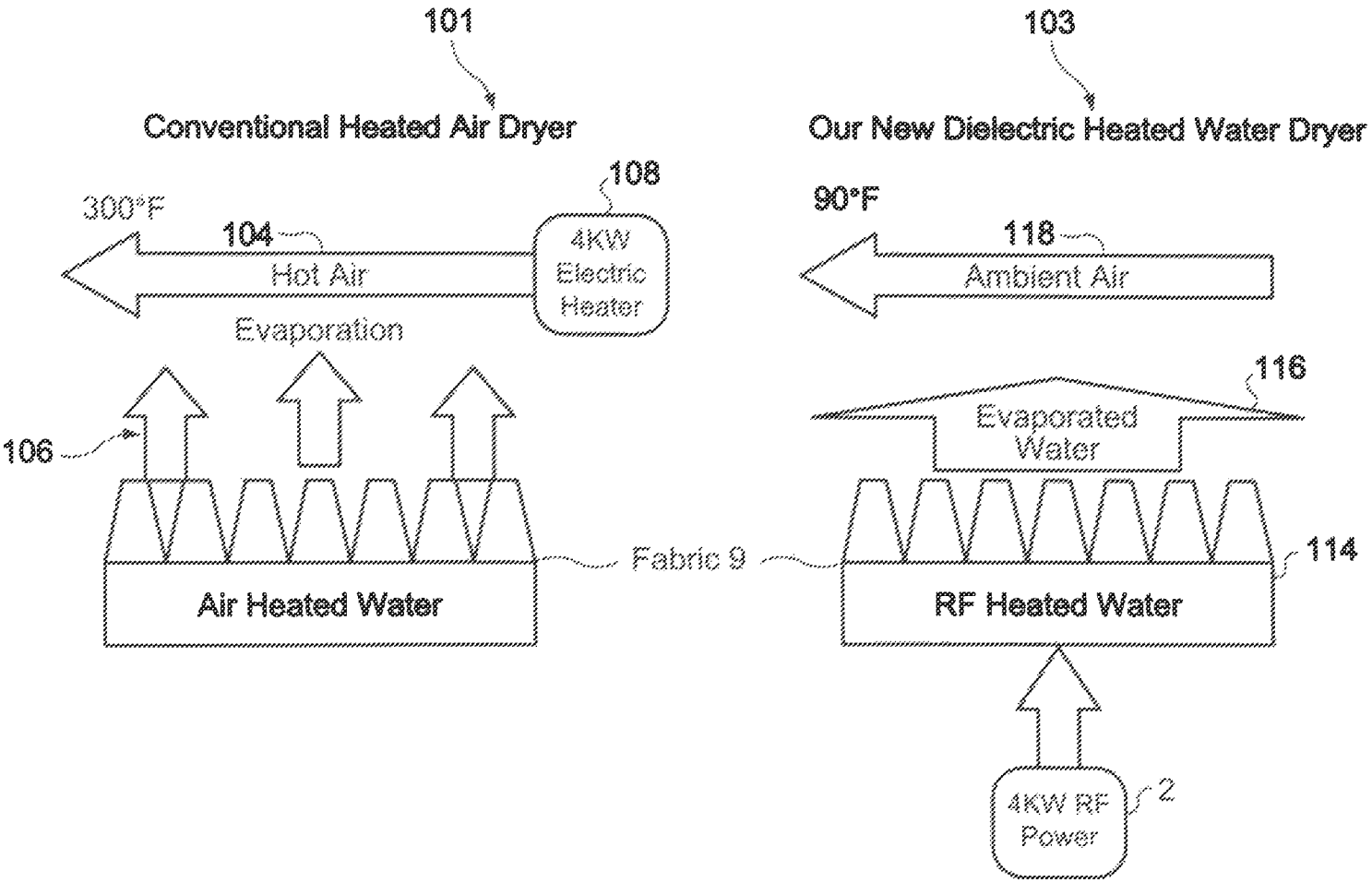

FIG. 4 illustrates a comparison between a conventional heated air dryer 101 and the dielectric dryer 103 of the present invention.

In the conventional heated air dryer 101, hot air 104 passes over the clothes surface, the hot air 104 both heats and removes surface moisture, and water inside the fabric must wick to the surface for removal.

The present invention, on the other hand, uses dielectric heated water 114. The long wavelength single low frequency RF energy 2 adds energy to the water in the fabric 9, uniformly vaporizing the water throughout the fabric. Within the selected low frequency range, the long wavelength penetrates through all of the clothes 9. A conventional size consumer clothes dryer enclosure 16 can be used to house components of the present invention. Air flow 118 is used only for removal of the evaporated water 116. The size of the drum 1 is not in any way related to the RF frequency. The basic processes of clothes heating and water removal are totally separated in the present invention; this is non-obvious in view of the prior art.

Figure 5:
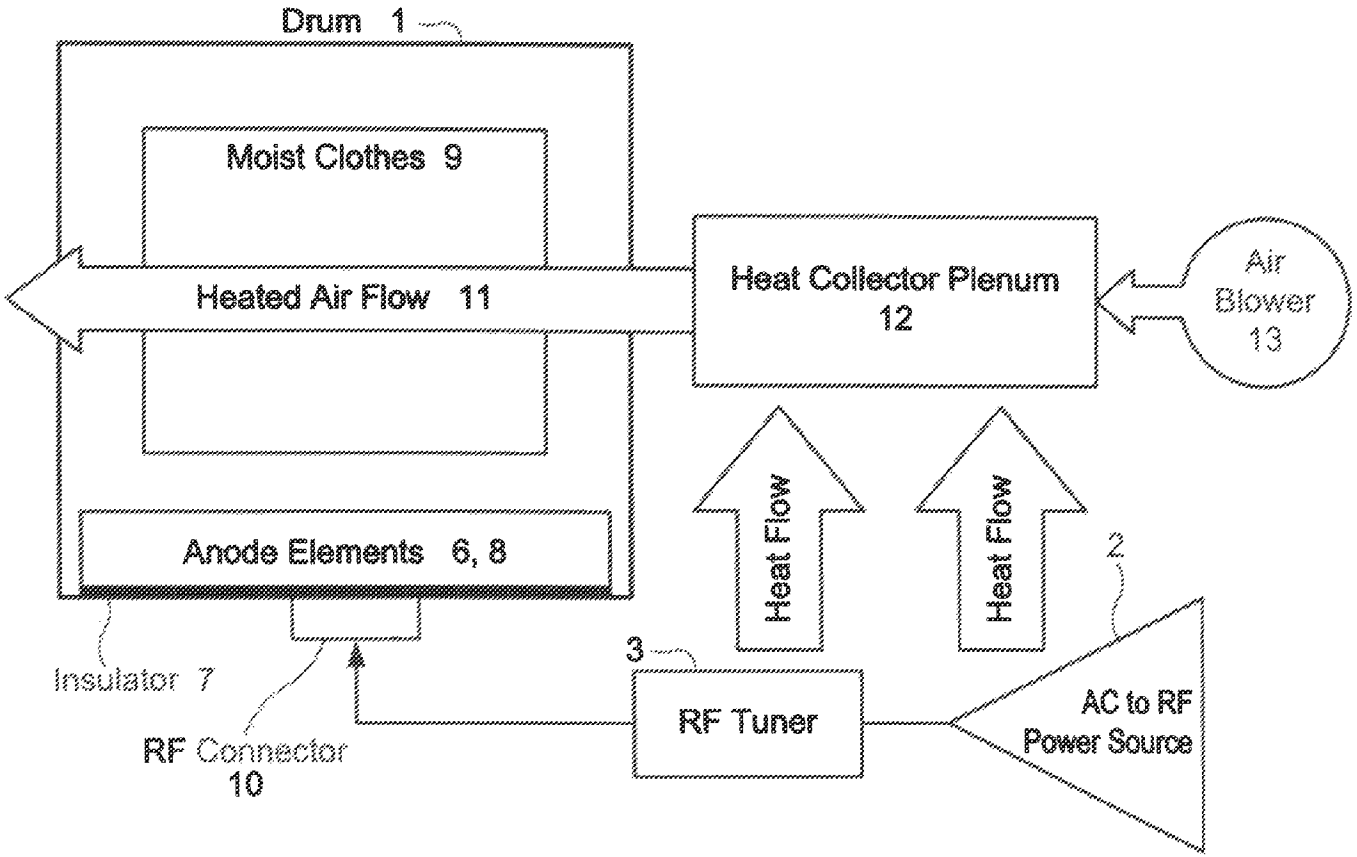

FIG. 5 is a block diagram of an embodiment of the present invention in which dryer efficiency is improved by recovering the heat generated from the operating solid state source 2 and RF tuner 3, and transferring the heat to a heated air collector plenum 12, while simultaneously and advantageously providing cooling for the electronics 2, 3.

Figures 6, 6A, 6B, 6C:
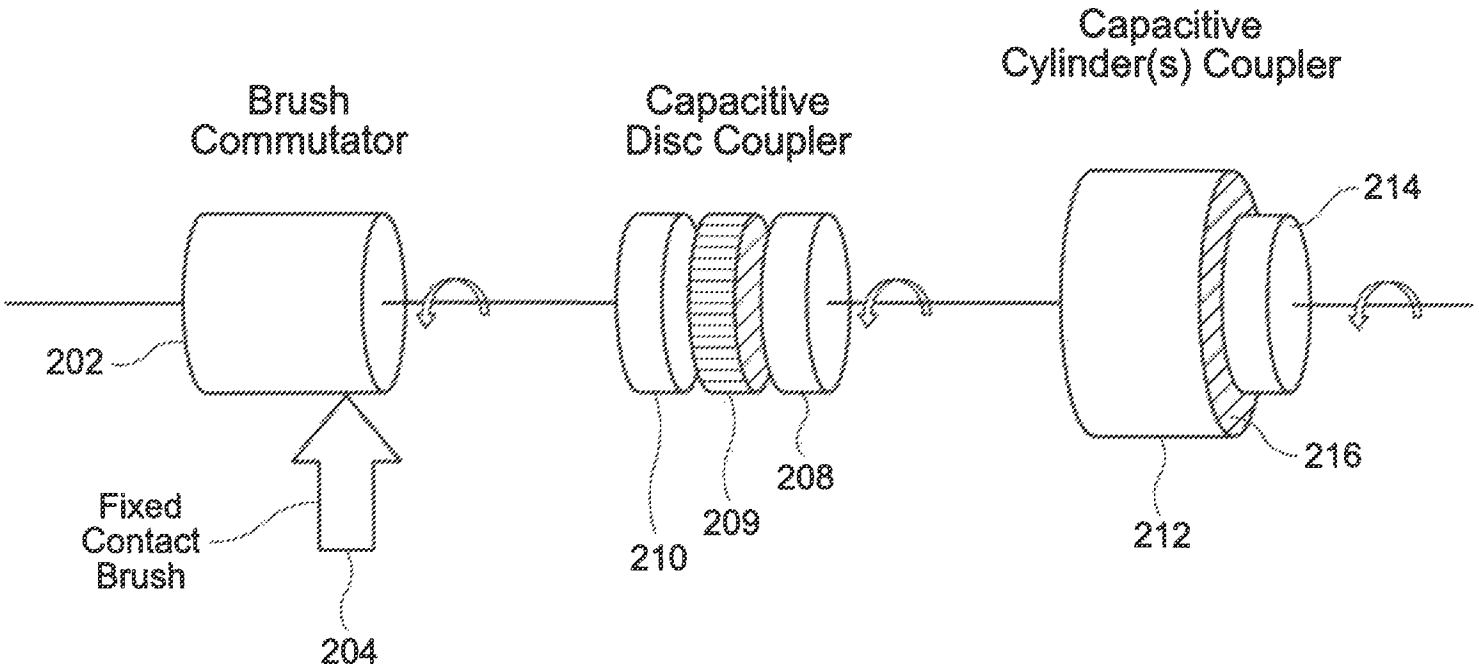

FIG. 6 is a sketch of an embodiment of the present invention depicting three different RF connections, in FIGS. 6(*a*), 6(*b*), and 6(*c*), respectively, used to couple rotating cathode and anode elements to the RF power source 2.

Figure 7:
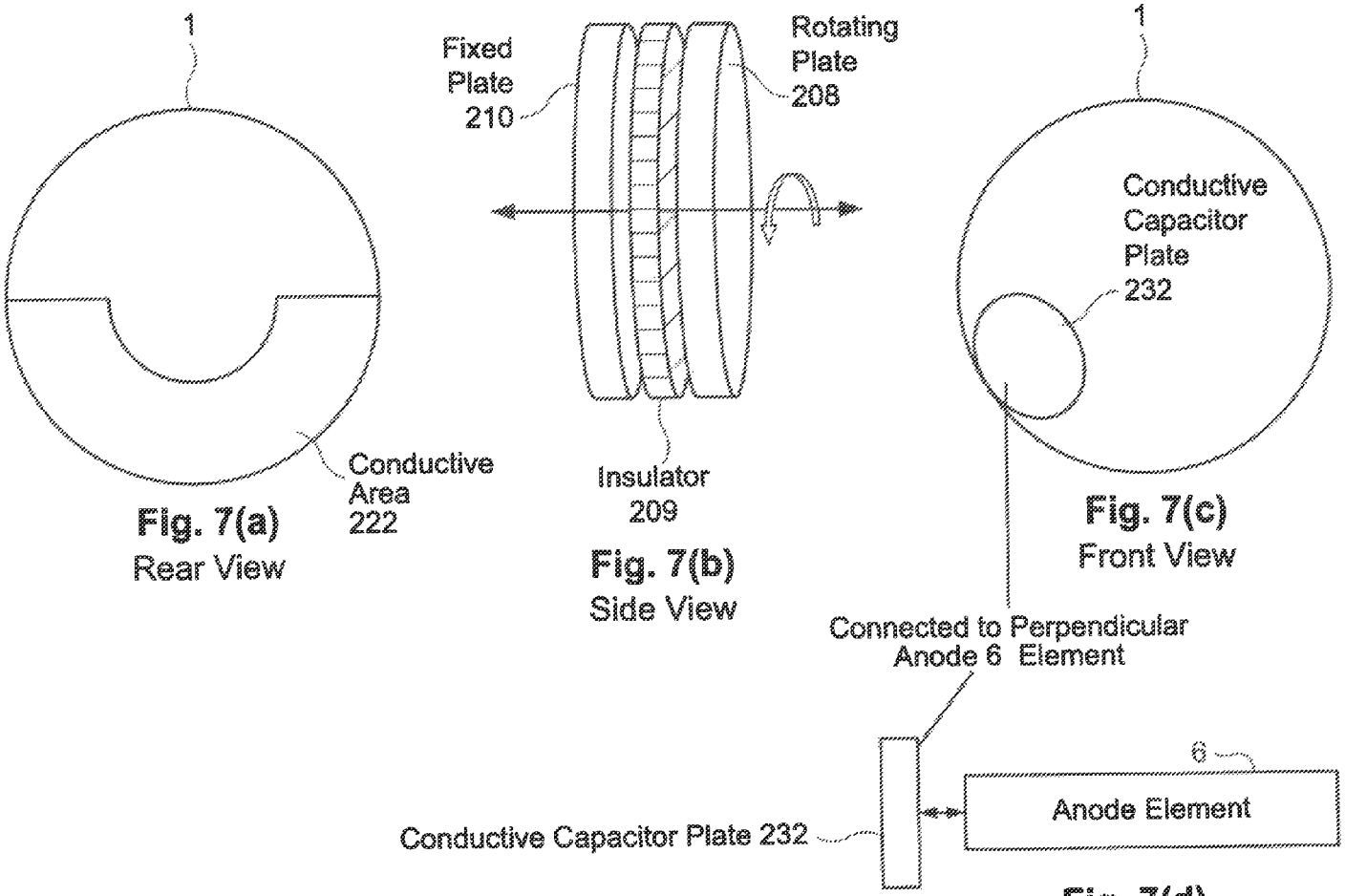

FIG. 7 comprises a series of sketches of an embodiment of the present invention, shown in FIG. 7(*b*) as employing a variable anode element coupling.

Figure 8:
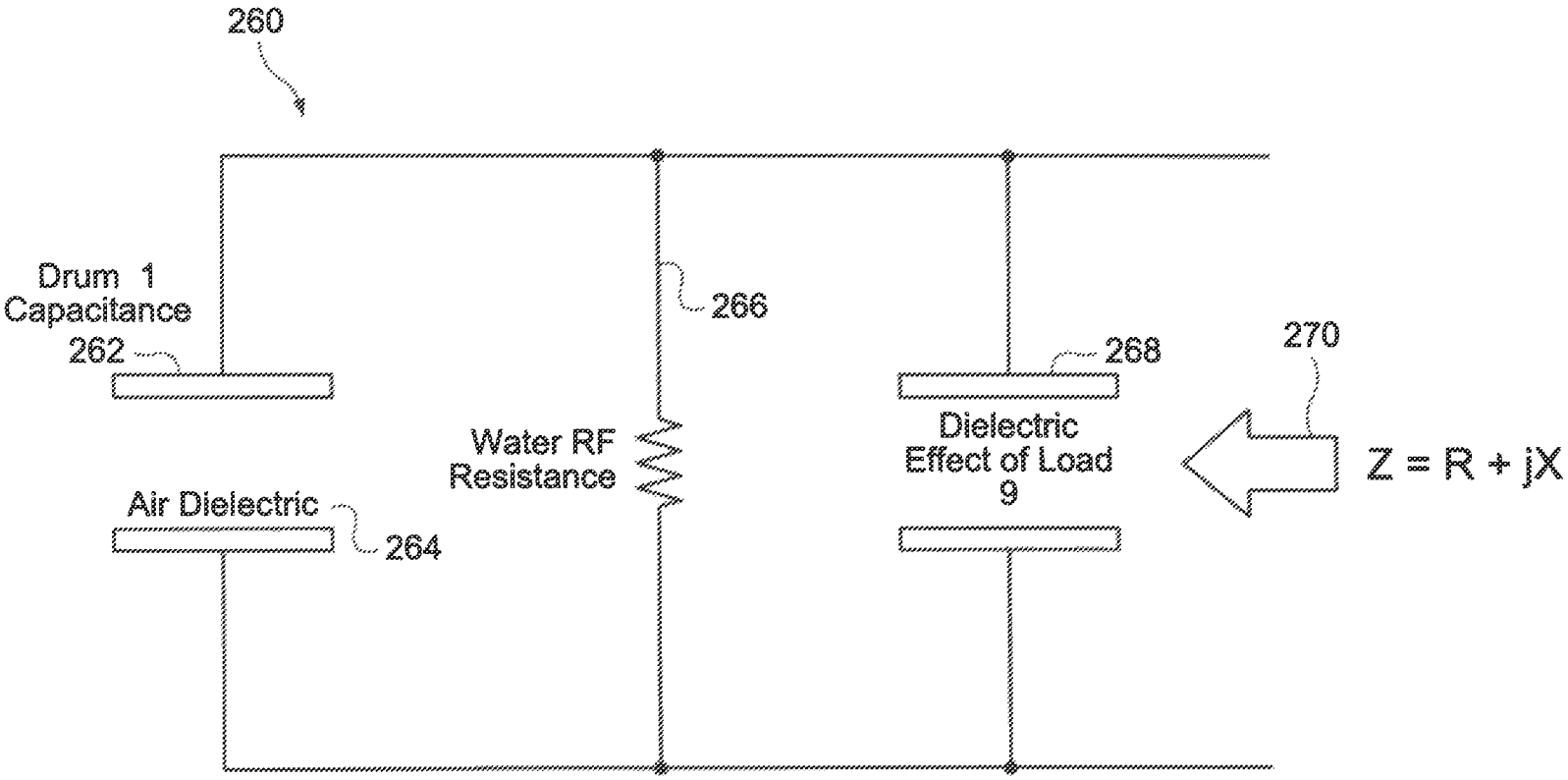

FIG. 8 is a simplified circuit diagram 260 showing a dielectric load model of the dielectric dryer drum 1 of the present invention.

Figure 9:
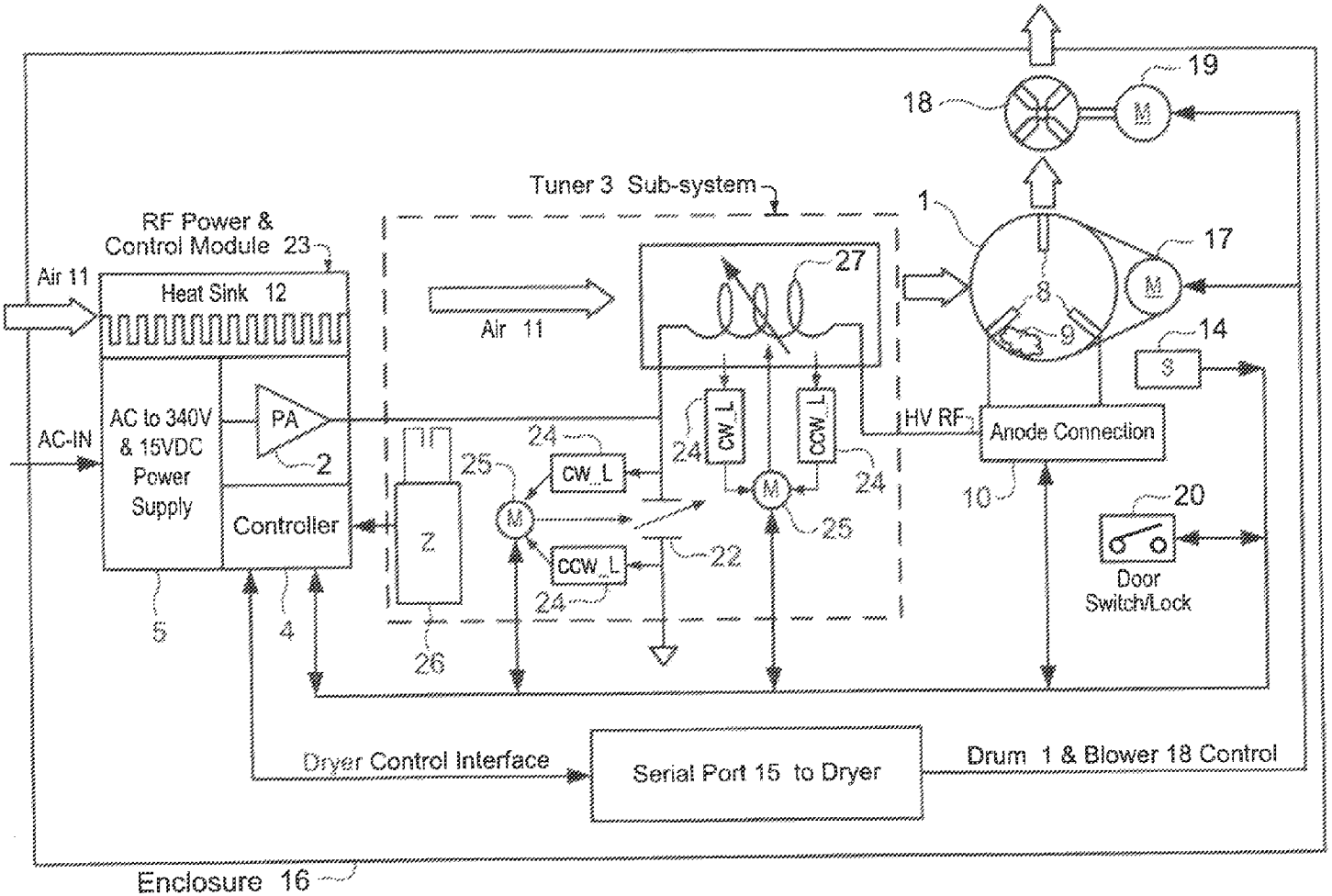

FIG. 9 is a detailed block diagram of an embodiment of the present invention.

DETAILED DESCRIPTION OF PREFERRED EMBODIMENTS

Reference now is made in more detail to embodiments of the present invention, examples of which are illustrated in the accompanying drawings. While the present invention will be described in conjunction with the various embodiments, it will be understood that they are not intended to limit the present invention to these embodiments. On the contrary, the present invention is intended to cover alternatives, modifications, and equivalents, which may be included within the spirit and scope of the various embodiments as defined by the appended claims.

In the following detailed description, numerous specific details are set forth in order to provide a thorough understanding of the presented embodiments. However, it will be obvious to one of ordinary skill in the art that the presented embodiments may be practiced without these specific details. In other instances, well-known methods, procedures, components, and circuits have not been described in detail, so as to not unnecessarily obscure aspects of the presented embodiments.

Figure 1:
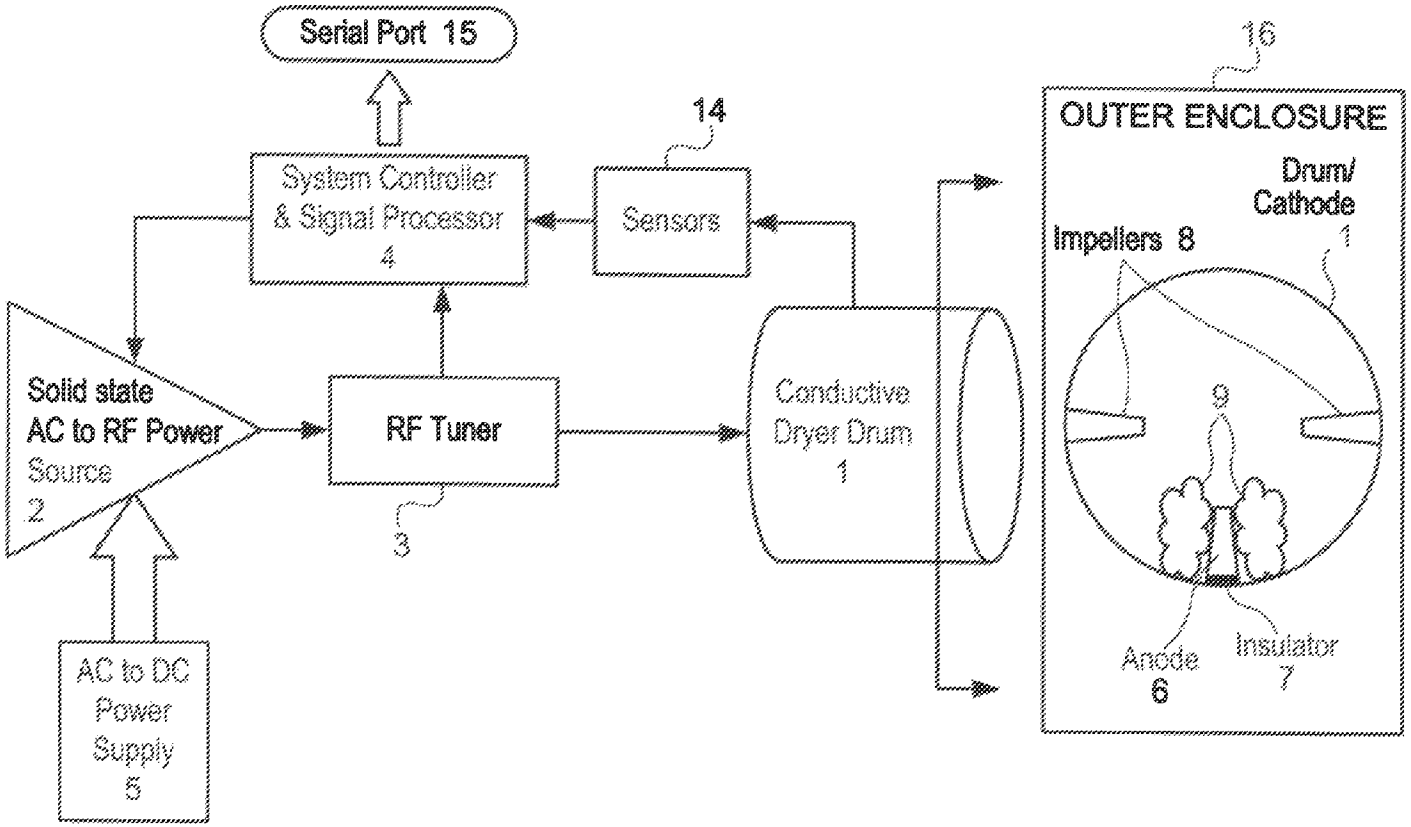
FIG. 1 is a block diagram of the present heating system configured for drying clothes 9. A front view of the drum 1 is shown, depicting axial anode 6 and impellers 8.

FIG. 1 illustrates general embodiments of the dielectric dryer of the present invention.

Cylindrical drum 1 is electrically conductive in the illustrated embodiment, and is used as a cathode. Electrically conductive anode 6 is axially positioned within drum 1. Together, anode 6 and drum/cathode 1 form a capacitor whose electrical field is used to heat the load 9. An air flow 11 (not shown in FIG. 1) is used to efficiently carry evaporated water out of the drum 1.

Essentially, this new way to introduce RF 2 into the drum 1 allows us to maintain a constant size and volume of the drum 1 (and therefore use conventional enclosures 16), without needing any moving parts inside the drum 1. Also, tuning the reactive component out of the load 9 can be readily and advantageously accomplished by turning on or off, electrically, some or all of the anode impeller vanes 8 inside the drum 1, for those embodiments where impellers 8 are electrically connected to anode 6.

In embodiments of the present invention, anode 6 has a double function: to scramble the clothes 9 as an additional impeller 8 for giving the clothes 9 better exposure to the air flow 11 that removes the moisture, and to provide the RF connection.

In embodiments of the present invention, each anode element 6, 8 is separated from the conductive drum 1 by an insulating material 7.

In embodiments of the preset invention the metal anode(s) 6,8 is/are protected from corrosion from the wet clothes 9 by an insulating material.

In embodiments of the present invention, the drum 1 material is selected from the group consisting of: an electrical conductor; a metal; an insulator; a dielectric insulator; a ceramic insulator; a plastic insulator; a wooden insulator; and a mixture of at least two of the above materials. In embodiments where drum 1 is not an electrical conductor, drum 1 does not act as a cathode, and so a separate cathode must be provided in order to complete the electrical circuit.

In embodiments of the present invention, object 9 is an object from the group consisting of: a cloth substance; a plastic substance; and a chemical substance. In preferred embodiments, object 9 comprises a moist load of clothing.

In preferred embodiments of the present invention, all drum 1 surfaces are electrically grounded.

FIG. 2 shows a dryer appliance conductive drum 1 where the single, low frequency electrical capacitive RF signal 2 is injected into the anode 6 (placed inside drum 1, and separated from drum 1 by insulator 7) through an RF tuner 3 and RF connector 10. Power is provided from a single, low frequency RF solid state source 2. All the elements are enclosed inside an outer enclosure 16, e.g., a cabinet. A suitable solid state RF power source 2 is disclosed in "Specification sheet for 1 KW Class E Module PRF-1150 power module, © 2002 by Directed Energy, Inc., downloaded on Mar. 17, 2014 from: http://ixys.com/SearchResults.aspx?search=class+E&SearchSubmit=Go."

The RF outputs of more than one such solid state power source 2 may be combined to provide higher powers that may be useful or needed to dry large loads 9, as is done in one embodiment of our invention.

In preferred embodiments of the present invention, the single, low frequency electrical capacitive RF signal is selected to be in the range of 10 MHz to 100 MHz. This corresponds to wavelengths in the range of 29.979 meters to 2.9979 meters.

This range of wavelengths is sufficiently large for the electrical capacitive energy to penetrate most materials 9 to be dried in conventional size consumer appliances 16, and low enough to be easily produced with solid state device power sources 2.

In embodiments of the present invention, the drum 1 is agitated continuously while the energy from the single, low frequency electrical capacitive RF source 2 is applied through the tuner 3 and RF connector 10.

In other embodiments of the present invention, the single low frequency, electrical capacitive RF signal 2 is intermittently applied to anode 6. This intermittent application may occur only while the drum 1 is in a static position, with the clothes 9 resting at the bottom of the drum 9, and not when the drum 1 is rotated. In such cases, drum 1 is then subsequently rotated to improve the air removal of the moisture and to randomize the deposit of the clothes 9 on the bottom of the drum 1. This sequence is repeated until the clothes 9 reach a desired preselected level of remaining moisture, as measured by sensors 14. Selections of the power-on time length and rotating-drum time length are optimized to provide maximum drying efficiency and minimum drying time. The selections can be made by system controller 4, based upon preselected criteria that have been programmed into controller 4.

The low frequency electrical capacitive RF energy from source 2 causes water evaporation from the clothes 9, whereas air flow 11 is used to carry the evaporated humidity out of the drum 1 and out of outer enclosure 16.

In embodiments of the present invention, the impedance Z that the drying clothes present to the single low frequency RF solid state source 2 through RF tuner 3 is monitored by sensors 14 and used by system controller 4 to determine the end point of the drying process.

In embodiments of the present invention, the conductive cathode area of the rotating drum 1 is connected to the ground return path of the RF power source 2 by a rotating or non-rotating capacitive connection 21.

In embodiments of the present invention, connector 10 comprises a rotating RF anode plate connector 202, 204, 210 of the type shown in FIG. 6.

In other embodiments of the present invention, as shown in FIG. 3, there are several anode impellers 8 inside the conductive drum cathode 1; each impeller 8 is electrically connected to anode 6 and separated from drum 1 by insulator 7. Each anode impeller 8 is driven with RF energy and is therefore a "hot anode", with the ground return being the entire drum 1. Each impeller 8 is shaped and placed into the drum 1 in a manner to maximize RF coupling to the tumbling or stationary load 9, while minimizing non-load-coupled parasitic capacitance.

In embodiments of the present invention, the insulating material separating the electrically conductive anode elements 6, 8 from the drum 1 is selected from the group consisting of glass; plastic; and ceramic.

The selection of the capacitive electrical energy wavelength has a lower limit, to avoid creating coupling of the drying energy to small metal objects that may be inside the drying load 9 of clothes. The preferred frequency range for RF power source 2 is selected in the 10 MHz to 100 MHz range.

FIG. 4 illustrates comparison between a conventional heated air dryer 101 and the dielectric dryer 103 of the present invention.

In the conventional heated air dryer 101, a 4 kW electric heater 108 causes heating of the hot air 104 that is preset inside the dryer up to 300° F. This hot air is used to heat the water 106 containing the clothes, evaporate the moisture, and blow the humidified air out of the dryer. Such hot temperature adversely affects the properties of the drying fabric.

On the other hand, in the dielectric dryer 103 of the present invention, the 4 kW applied RF power 2 causes evaporation of the RF heated water 114, but does not cause heating of the ambient air 118, which has temperature only up to 90° F. (room temperature). Such ambient temperature does not adversely affect the properties of the drying fabric 9, illustrating the superiority of the present invention 103.

FIG. 5 shows an embodiment of the present invention in which heat recovery is employed. Heat dissipation from power source 2 and RF tuner 3 is channeled upward into a heat collector plenum 12. Air blower 13 blows air through plenum 12 and drum 1. The resulting heated air flow 11 dries the ambient air within drum 1, and expels the air out the enclosure 16. This improves the overall energy efficiency of the system.

In embodiments of the present invention, the direction of rotation of drum 1 is varied to prevent bunching of the drying load 9.

In embodiments of the present invention, the system controller and signal processor 4 is configured to control parameters of the configurable RF waveform power source 2 in real time by using real time data provided by the block 14 of RF and physical sensors.

In embodiments of the present invention, the shape of anode elements 6, 8 is selected to optimize RF load coupling while minimizing parasitic capacitance to ground.

In embodiments of the present invention, the shape of anode elements 6, 8 is optimized to accommodate for different kinds of fabrics 9 and different kinds of load 9.

In embodiments of the present invention, the rotating RF anode plate connector 10 is selected from the group consisting of a brush-contact commutator; and a capacitive coupling.

In embodiments of the present invention, the rotating RF anode connector 10 comprises a capacitive or non-capacitive coupling selected from the group consisting of: a parallel plate; and at least one concentric cylinder.

FIG. 6 illustrates three acceptable connections 10 to rotating cathode 1 and anode 6, 8 elements. In all three examples, the anode 6 is assumed to rotate with the drum 1, as indicated by the arrows in each of FIGS. 6(*a*), 6(*b*), and 6(*c*).

In a first embodiment, the anode 6 is coupled to the RF tuner 3 by using a fixed contact brush 204 that is coupled to tuner 3 and makes contact with a rotating brush commutator 202 that is coupled to the rotating anode 6, as shown in FIG. 6(*a*).

In a second embodiment, shown in FIG. 6(*b*), anode 6 is coupled to the RF source 2 and tuner 3 via a capacitive disc coupler comprising three axially aligned discs 208, 209, 210. In this embodiment, the inner (rightmost) disc 208 rotates and is coupled to the anode 6, the center disc 209 is an insulator, and the outer (leftmost) disc 210 is stationary and coupled to tuner 3.

In a third embodiment, anode 6 is coupled to RF source 2 and tuner 3 via a single capacitive cylinder disc coupler, as shown in FIG. 6(*c*). In this embodiment, the inner (rightmost) cylinder 214 is rotating and connected to anode 6, dielectric spacer 216 radially surrounds cylinder 214 and is an insulator, and the outer (leftmost) disc 212 is stationary and coupled to tuner 3.

FIG. 7 illustrates an embodiment of the present invention in which variable anode element coupling is employed to implement the capacitive disc coupler of FIG. 6(*b*). The coupling comprises three concentric plates: fixed plate 210, insulator 209, and rotating plate 208, as shown in the FIG. 7(*b*) side view and in FIG. 6(*b*). Typically, only a portion 222 of fixed plate 210 needs to be electrically conductive, as shown in the FIG. 7(*a*) rear view. Conductive capacitor plate 232 is attached to the anode 6, as shown in the FIG. 7(*d*) side view. FIG. 7(*c*) is a front view showing a typical location for plate 232 within drum 1.

FIG. 8 shows a dielectric load model 260 of the circuit of dielectric dryer drum 1.

The drum 1 has an inherent capacitance 262, based on its physical dimensions and the permittivity of the air dielectric 264 that is present between the cathode 1 and anode 6, 8. The water in the load 9 has an RF resistance 266 related to the amount of water. The materials in the load 9 add an additional capacitance 268 to the model 260; their dielectric constant is greater than 1. Thus, the overall load impedance 270 Z is:

$$Z=R+jX$$

The load impedance Z is dependent upon the size, water content, fabric type, and physical shape and volume of the load 9.

The present invention seeks to dynamically maximize RF coupling to the load resistance (water). The design optimizes the tuning to the current value of the water resistance, while minimizing parasitic capacitance 268.

In embodiments of the present invention, the capacitive element 268 of the load 9 can be minimized by changing the number of impellers 8 that are actuated electrically by controller 4 (see FIG. 1), by mechanically interspersing coupling capacitors between pairs of impellers 8, and by dynamically changing the tuning of the LC network 3, 22 shown in FIG. 9 with positional signals from digi-switches 24 and 25 and impedance Z measuring network 26.

In embodiments of the present invention, as illustrated in FIG. 9, parameters such as the RF impedance Z of the load 9 as measured by sensor 26 and the amount or percentage of water in the load 9 as measured by a sensor 14 are fed in real time to controller 4, which then determines the end time for the heating process. Controller 4 then stops the heating by means of shutting down power source 2. In other embodiments, controller 4 changes the values of tuning capacitor 22 and/or tuning inductor 27 in real time, by means of sending control signals to one or both of the motors 25 that control the physical settings of capacitor 22 and inductor 27, respectively. Controller does this, for example, to remove the reactive component (jX) out of impedance Z as much as possible, to maximize the efficiency of the system.

FIG. 9 depicts a dielectric heating system block diagram comprising a DC power supply 5, a real time configurable RF waveform power source 2, a system controller and signal processor module 4, a serial port 15, a set 14 of RF and physical sensors, dryer drum 1, and related components. Serial port 15 can be used to change parameters within controller 4 via an outboard computer (not illustrated). These parameters can include the preselected degree of humidity that will cause controller 4 to shut down application of power from RF source 2 in order to end the drying process. Physical characteristics such as heat and humidity are measured by sensors 14 and fed to controller 4 via serial port 15. Impedance Z as measured by sensor 26 and micro-switch 24 positions are also fed to controller 4, which adjusts operating characteristics (e.g., power, amplitude, duration, pulsing) of RF source 2 so that the dryer operation stays within preselected ranges. This measurement and control can be accomplished, e.g., by one or more feedback loops.

Modules 2, 4, 5, and 12 can be fabricated together as a single RF Power and Control Module 23.

Anode(s) 6, 8 connection 10 can be implemented by any of the couplings shown in FIGS. 6 and 7.

Drum 1 is rotated by motor 17. Motor 17 or another motor 19 can be used to activate exhaust fan 18 to facilitate the expulsion of ambient air out of enclosure 16. Door switch/lock 20 can be manually or electronically activated to operate a physical door through which load 9 is inserted into the drum 1 prior to drying, and removed from drum 1 subsequent to drying.

In embodiments of the present invention, the heating process is controlled by selecting parameters of the real time configurable RF waveform power source 2 from the group consisting of: an applied RF voltage magnitude and envelope wave shape; an applied RF current magnitude and envelope wave shape; phase of RF voltage vs. current; voltage standing wave ratio (VSWR); and RF frequency.

In embodiments of the present invention, RF tuner 3 can comprise a subsystem including variable tuning inductor 27, variable tuning capacitor 22, and impedance sensor 26. Values of inductor 27 and capacitor 22 are adjusted by means of controller 4 actuating clockwise and counter clockwise digi-switches 24, which in turn control a pair of motors 25 that control the values of inductor 27 and capacitor 22 in real time. The object of this control is to tune out the (−jX) from the load RF impedance Z, thus yielding a pure resistive load R at the anode connection 10. This maximizes drying efficiency.

In embodiments of the present invention, the set 14 of physical sensors is configured to measure the size and water content of the load 9, the load 9 temperature, and parameters of the air flow 11 within drum 1. As discussed above, sensors 14 feed these parameters to controller 4 via serial port 15.

In embodiments of the present invention, the method for heating an object 9 having a variable weight that includes a medium comprises the step of placing the object 9 having the variable weight including the medium into an enclosure 16; wherein the object 9 substantially has absorbed the medium in a first "cool" state; and the object 9 includes a maximum weight in the first "cool" state due to absorption of the medium.

In embodiments of the present invention, the method for heating an object 9 having a variable weight that includes a medium further comprises the step of initiating a heating process by subjecting the object and medium to a low frequency RF electrical current 2 inside a capacitive enclosure 1 where there is electrical contact of the object 9 to the anode 6 and cathode 1 electrodes, the object is substantially free from the medium in a second "heated" state due to substantial release of the medium from the object, and the released medium is evaporated during the heating process.

In embodiments of the present invention, the method for heating an object 9 having a variable weight that includes a medium further comprises the step of controlling the heating process by controller 4, wherein controller 4 completes the heating process when the object is substantially transitioned into the second "heated" state. "Substantially transitioned" is defined by preselected parameters that have been programmed into controller 4.

In embodiments of the present invention, the method for heating an object 9 having a variable weight that includes a medium further comprises the step of using an air flow 11 having an ambient or heated temperature inside the enclosure 16 to carry away the evaporated medium from the enclosure 16.

In embodiments of the present invention, the enclosure comprises a dryer drum 1 that serves as a cathode, and at least one anode vane 8 of variable shape; the object comprises a load of clothing 9; and the medium comprises water. The method for heating the load of clothing 9 further comprises the step of optimally configuring the shape of at least one anode vane (impeller) 8 to accommodate for different kinds of fabrics and different kinds of load 9.

In embodiments of the present invention, the method for heating the load of clothing 9 further comprises the step of pre-heating ambient air inside the dryer drum 1 to facilitate water evaporation from the drum 1.

In embodiments of the present invention, the method for heating the load of clothing 9 further comprises the step of controlling an air flow 11 rate by measuring the air flow, preferably in real time, by an air flow sensor 14, and by utilizing system controller 4 to regulate the air flow 11 rate, taking into account the measured air flow 11 rate.

In embodiments of the present invention, the method for heating the load 9 further comprises the step of controlling an air flow 11 path by a variable element design selected from the group consisting of: an intake air duct design (not shown); a chamber design (not shown); and a drum impeller 8 design. The design is configured to facilitate removal of evaporated water from the enclosure 16.

The above discussion has set forth the operation of various exemplary systems and methods. In various embodiments, one or more steps of a method of implementation can be carried out by a processor under the control of computer-readable and computer-executable instructions. In some embodiments, these methods are implemented via a computer contained in, or otherwise associated with, system controller 4. The computer-readable and computer-executable instructions may reside on one or more computer useable/readable media, such as one or more hard disks, optical disks, and/or flash memories.

Therefore, one or more operations of various embodiments may be controlled or implemented using computer-executable instructions, such as program modules, being executed by the computer. Generally, "program modules" include routines, programs, objects, components, data structures, etc., that perform particular tasks or implement particular abstract data types. The program modules can be implemented in any combination of hardware, firmware, and/or software. The present invention may also be practiced in distributed computing environments where tasks are performed by remote processing devices that are linked through a communications network. In a distributed computing environment, program modules may be located in both local and remote computer-storage media, including memory-storage devices.

Although specific steps of exemplary methods of implementation are disclosed herein, these steps are examples of steps that may be performed in accordance with various exemplary embodiments. Embodiments disclosed herein are well suited to performing various other steps or variations of the steps recited. Moreover, the steps disclosed herein may be performed in an order different than presented above, and not all of the steps are necessarily performed in a particular embodiment.

Although various electronic and software based systems are discussed herein, these systems are merely examples of environments that might be utilized, and are not intended to suggest any limitation as to the scope of use or functionality of the present invention. Neither should such systems be interpreted as having any dependency or relation to any one or combination of components or functions illustrated in the disclosed examples.

Although the subject matter has been described in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A method for heating a load including an absorbed medium, said method comprising the steps of:

heating said load and medium within a rotating enclosure by subjecting said load and medium to an AC electrical field originated from an RF power source and embodied as a capacitor; wherein said load becomes substantially free from said medium after being heated, due to release of said medium from said load;

controlling said heating by taking real time impedance measurements and by controlling parameters of the RF power source in real time based upon said measurements; and terminating said heating when said load reaches a preselected degree of freedom from said medium.

2. The method of claim 1 wherein the enclosure comprises an electrically conductive dryer drum having an electrically conductive anode and an electrically conductive cathode, the anode and cathode being separated from each other by an electrically insulating material.

3. The method of claim 2 wherein the cathode is coupled to ground via a coupling from the group of couplings consisting of a capacitive coupling and a direct coupling.

4. The method of claim 2 further comprising maximizing contact between the load and the anode, and between the load and the cathode, to minimize parasitic air capacitance to improve transfer of energy to the load.

5. The method of claim 2 wherein said insulating material is from the group consisting of glass; plastic; and ceramic.

6. The method of claim 2 wherein said heating step comprises rotating said drum with varying rotation speed.

7. The method of claim 2 further comprising inserting a variable tuning inductor and capacitor network between the RF power source and the anode, whereby power transfer from the RF power source to the load including the medium is enhanced.

8. The method of claim 2 wherein the anode is positioned within the drum.

9. The method of claim 1 wherein the anode is coupled to the RF power source by a coupling from the group of couplings consisting of a capacitive coupling and a brush commutator.

10. The method of claim 1 wherein the load comprises articles of clothing, and the medium comprises water.

11. The method of claim 1 further comprising causing an air flow inside said enclosure to carry away an evaporated state of said medium from said enclosure.

12. The method of claim 1 wherein said load is from the group consisting of at least one cloth substance; at least one food substance; at least one wood substance; at least one plastic substance; and at least one chemical substance.

13. The method of claim 1 wherein said enclosure is electrically conductive and from the group consisting of a cylindrical cathode drum having at least one impeller; and a cylindrical drum having at least one cathode end plate.

14. The method of claim 1 wherein said enclosure comprises a material from the group of materials consisting of a conductor; a metal; an insulator; a dielectric insulator; a ceramic insulator; a plastic insulator; and a wooden insulator.

15. The method of claim 11, wherein:

the load comprises a plurality of items to be dried; and said rotating comprises varying a direction of rotation of said drum to thwart bunching of said items.

16. The method of claim 1 wherein:

the enclosure comprises a rotating drum having a cathode area; and the conductive cathode area is coupled to a ground return path of said RF power source by a rotating or non-rotating connection.

17. The method of claim 1 further comprising interspersing a plurality of passive anode elements within the enclosure.

18. The method of claim 1 wherein the measurements are from the group of measurements consisting of RF impedance of the load including the medium; temperature of the load including the medium; and parameters of air flow within the enclosure.

19. The method of claim 1 wherein the parameters of the RF power source are from the group of RF parameters consisting of an applied RF current magnitude and envelope wave shape; phase of RF voltage versus current; voltage standing wave ratio; and RF frequency.

20. The method of claim 1 wherein the RF power source operates at a single RF frequency between 10 MHz and 100 MHz.

21. The method of claim 1 wherein the AC electrical field causes evaporation of the medium, but does not heat ambient air contained within said enclosure.

22. The method of claim 1 further comprising:

collecting heat emanating from the RF power source in a heat collector plenum; and causing air to flaw across the plenum and through the enclosure, whereby this heated air contributes to the drying of the load.

23. Apparatus for heating a load including an absorbed medium, said apparatus comprising:

an RF power source adapted to generate a capacitive AC electrical field within a rotating enclosure, wherein the load and medium are positioned within the AC electrical field, and the AC electrical field causes heating of the load and medium until the load becomes substantially free from the medium due to release of the medium from the load to a preselected degree;

coupled to the AC electrical field, sensors including an impedance sensor for taking real time measurements of conditions within the enclosure; and coupled to the sensors and to the RF power source, a control module for terminating activation of the RF power source when the sensors have indicated to the control module that the load has reached a preselected degree of freedom from the medium.

24. The apparatus of claim 23 wherein the enclosure comprises:

a rotating dryer drum acting as an electrically conductive cathode; and an electrically conductive anode, the anode and cathode being separated from each other by an electrically insulating material; wherein the capacitive AC electrical field is formed between the anode and the cathode.

25. The apparatus of claim 24 wherein the anode is positioned within the drum.

26. The apparatus of claim 24 wherein the anode is coupled to the RF power source by a coupling from the group of couplings consisting of a capacitive coupling and a brush commutator.

27. The apparatus of claim 23 wherein the RF power source operates at a single RF frequency between 10 MHz and 100 MHz.

28. The apparatus of claim 23 wherein the AC electrical field causes evaporation of the medium, but does not heat ambient air contained within the enclosure.

29. The apparatus of claim 23 further comprising:

a heat collector plenum positioned to collect heat emanating from the RF power source; and associated with the plenum, an air blower adapted to produce an air flow across the plenum and through the enclosure, whereby this heated air contributes to drying of the load.

* * * * *

UNITED STATES PATENT AND TRADEMARK OFFICE

CERTIFICATE OF CORRECTION

PATENT NO. : 9,200,402 B2
APPLICATION NO. : 14/336599
DATED : December 1, 2015
INVENTOR(S) : David S. Wisherd et al.

It is certified that error appears in the above-identified patent and that said Letters Patent is hereby corrected as shown below:

On the Title page, column 1, item (71)

"(71) Applicant: Cool Dry LLC, San Jose, CA (US)" should be corrected to read

--(71) Applicant: Cool Dry, Inc., San Jose, CA (US)--.

Signed and Sealed this
Twenty-third Day of February, 2016

Michelle K. Lee

Michelle K. Lee
*Director of the United States Patent and Trademark Office*